US006382927B1

(12) United States Patent
Sonobe et al.

(10) Patent No.: US 6,382,927 B1
(45) Date of Patent: May 7, 2002

(54) VALVE PLATE ASSEMBLY POSITIONING STRUCTURE FOR COMPRESSOR

(75) Inventors: Masanori Sonobe; Tomoji Tarutani; Kenta Nishimura; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/533,838

(22) Filed: Mar. 23, 2000

(30) Foreign Application Priority Data

Apr. 1, 1999 (JP) ..... 11-094997

(51) Int. Cl.[7] ..... F04B 1/12; F04B 39/10
(52) U.S. Cl. ..... 417/269; 417/571
(58) Field of Search ..... 417/269, 222.2, 417/571; 137/514

(56) References Cited

U.S. PATENT DOCUMENTS

| | | | | |
|---|---|---|---|---|
| 4,226,572 A | | 10/1980 | Nakayama et al. | 417/269 |
| 4,950,132 A | * | 8/1990 | Brian, Jr. et al. | 417/269 |
| 5,100,306 A | * | 3/1992 | Moran, Jr. et al. | 417/571 |
| 5,316,447 A | * | 5/1994 | Fujii et al. | 417/269 |
| 5,613,836 A | * | 3/1997 | Takenaka et al. | 417/222.2 |

FOREIGN PATENT DOCUMENTS

| | | | |
|---|---|---|---|
| DE | 196 14 186 A1 | | 10/1996 |
| EP | 0 447 027 A1 | | 9/1991 |
| GB | 1119710 | * | 7/1968 |
| JP | 55-156282 | | 11/1980 |
| JP | 02-090368 | | 7/1990 |
| JP | 09-209931 | | 8/1997 |
| JP | 09-264254 | | 10/1997 |
| JP | 10-231783 | | 9/1998 |

OTHER PUBLICATIONS

European Patent Office Communication, Application No. 00106956.6, Date Jan. 22, 2001.

* cited by examiner

*Primary Examiner*—Charles G. Freay
*Assistant Examiner*—Michael K. Gray
(74) *Attorney, Agent, or Firm*—Morgan & Finnegan, LLP

(57) ABSTRACT

A compressor includes a cylinder block having a cylinder bore. A valve plate assembly is located between the cylinder block and a rear housing. The valve plate assembly includes a plurality of plates. The rear housing is connected with the cylinder block through the valve plate assembly. A pair of pins engage all the plates to determine the position of the valve plate assembly relative to at least one of the cylinder block and the rear housing.

11 Claims, 5 Drawing Sheets

VALVE PLATE ASSEMBLY POSITIONING STRUCTURE FOR COMPRESSOR

BACKGROUND OF THE INVENTION

The present invention relates to valve plate assembly positioning structures for compressors.

Japanese Unexamined Utility Model Publication No. 55-156282 and Japanese Unexamined Patent Publication No. 10-231783 describe typical valve plate assembly positioning structures for compressors. These structures includes projections, or dowels. Specifically, as shown in FIGS. 6 and 7, a piston type compressor of Japanese Unexamined Utility Model Publication No. 55-156282 includes a cylinder block 51 and a housing section 52. A valve plate assembly 53 is arranged between the cylinder block 51 and the housing section 52. The valve plate assembly 53 includes a first section 54, a main section 55, a second section 56, and a third section 57.

A plurality of cylinder bores 58 are formed in the cylinder block 51. Each cylinder bore 58 accommodates a piston 59. The pistons 59 move in the associated cylinder bores 58. The main section 55 has suction ports 55*a* and discharge ports 55*b*. The first section 54 includes a plurality of suction valves 54*a*. Each suction valve 54*a* is located at a position corresponding to the associated suction port 55*a*. The second section 56 includes a plurality of discharge valves 56*a*. Each discharge valve 56*a* is located at a position corresponding to the associated, discharge port 55*b*.

The main section 55 has a plurality of (in this case, two) projections 60. The projections 60 are formed in the main section 55 by pressing. As shown in FIG. 7, the second section 56 has a plurality of (in this case, two) holes 61 at positions corresponding to the projections 60. A discharge chamber 62 and a suction chamber 63 are defined in the housing section 52. The suction chamber 63 surrounds the discharge chamber 62. A partition 52*a* separates the discharge chamber 62 from the suction chamber 63.

As shown in FIG. 6, the first section 54, the main section 55, and the third section 57 are secured to an outer wall 64 of the rear housing section 52 and an outer wall of the cylinder block 51 by a plurality of pins 66. The second section 56 is positioned relative to the main section 55 by engagement of the projections 60 with the associated holes 61.

Normally, the second section 56 of the valve plate assembly 53 is sized to fit in the discharge chamber 62. As described above, a positioning structure for the second section 56 includes the projections 60.

However, if the valve plate assembly positioning structure employs the projections 60, the projections 60 must be formed on the main section 55 with a press. This step complicates the manufacturing procedure of the main section 55. Furthermore, since the length of the projections 60 is relatively small, the compressor may be assembled without fitting the projections 60 of the main section 55 securely in the associated holes 61 of the second section 56. The second section 56 may thus deviate from the proper position relative to the main section 55. To avoid this problem, the length of the projections 60 may be increased such that the projections 60 are more reliably fitted in the associated holes 61. This measure would prevent the second section 56 from deviating from the proper position relative to the main section 55. However, if the length of the projections 60 is increased, the accuracy of forming the projections 60 is decreased, thus reducing the positioning accuracy of the second section 56.

Furthermore, the projections 60 may be replaced by pins. However, this increases the number of parts used for positioning the valve plate assembly 53, thus complicating the positioning structure as a whole.

SUMMARY OF THE INVENTION

Accordingly, it is an objective of the present invention to provide a simplified valve plate assembly positioning structure for compressors.

To achieve the above objective, the present invention provides a compressor. The compressor comprises a cylinder block having a cylinder bore. A housing element has a suction chamber and a discharge chamber. A valve plate assembly is located between the cylinder block and the housing element to separate the cylinder bore from the suction chamber and the discharge chamber. The valve plate assembly includes a plurality of plate elements. The housing element is connected with cylinder block through the valve plate assembly. A positioning member engages all the plate elements to determine the position of the valve plate assembly relative to at least one of the cylinder block and the housing element.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

One embodiment of a valve plate assembly positioning structure for a swash plate type variable displacement compressor according to the present invention will now be described with reference to FIGS. 1 to 5.

Figure 1:
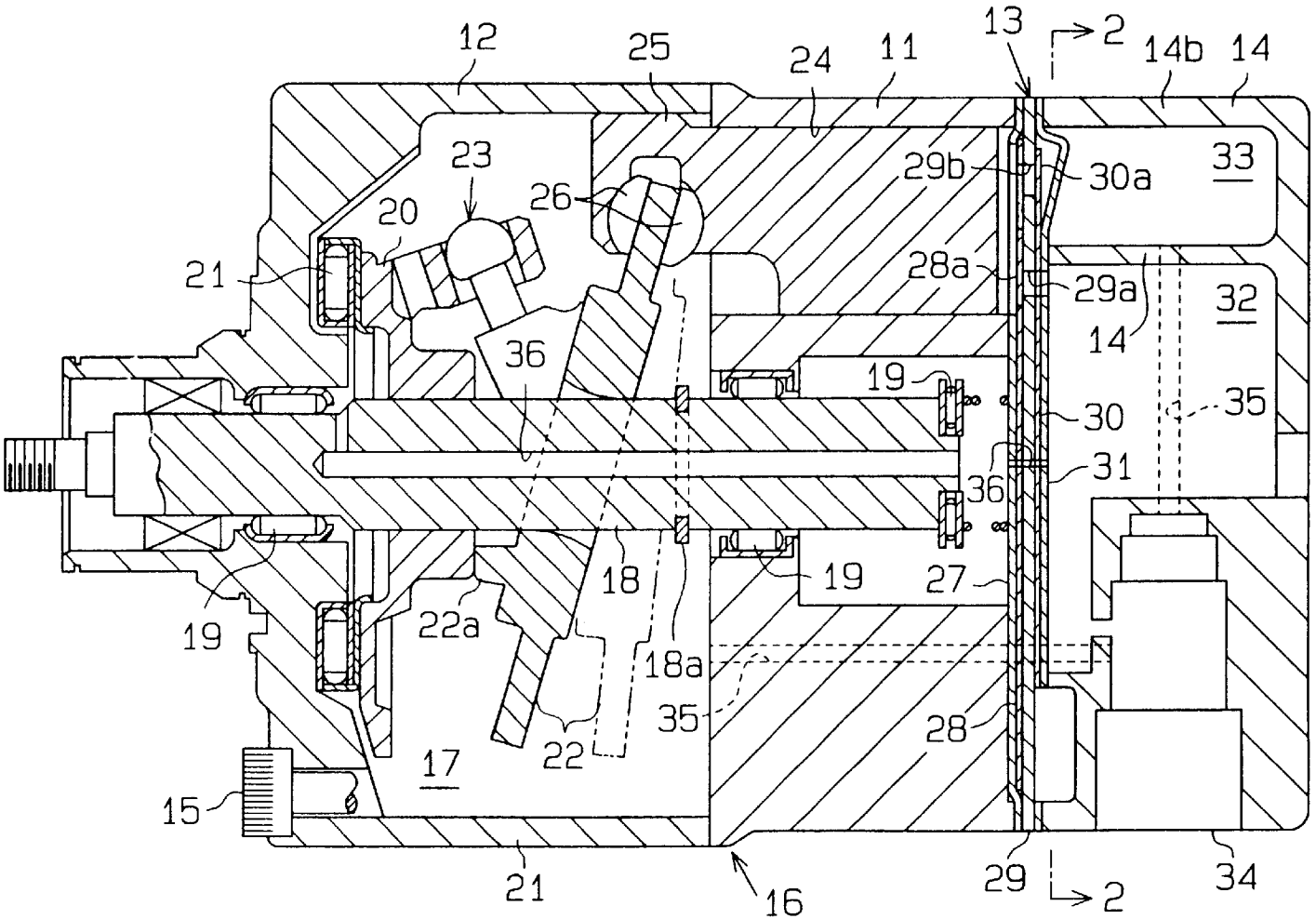
FIG. 1 is a cross-sectional view showing a compressor of one embodiment according to the present invention.

As shown in FIG. 1, the swash plate type variable displacement compressor includes a cylinder block 11, a front housing section 12, and a rear housing section 14. The front housing section 12 is connected with a front end (to the left as viewed in FIG. 1) of the cylinder block 11. The rear housing section 14 is connected with a rear end (to the right as viewed in FIG. 1) of the cylinder block 11 with a valve plate assembly 13 arranged between the cylinder block 11 and the rear housing section 14. A plurality of through bolts 15 (only one is shown in FIG. 1) securely fasten the cylinder block 11, the front housing section 12, and the rear housing section 14 together. The cylinder block 11, the front housing section 12, and the rear housing section 14 thus define a compressor housing 16.

A crank chamber 17 is defined by the cylinder block 11 and the front housing section 12. The cylinder block 11 and the front housing section 12 support a drive shaft 18 with bearings 19. A front end of the drive shaft 18 projects from the front housing section 12. The front end of the drive shaft 18 is connected with an external drive source (not shown), for example, an automotive engine, through a clutch (not shown) or the like.

A rotor 20 is secured to the drive shaft 18 in the crank chamber 17. A thrust bearing 21 is mounted to an inner wall of the front housing section 12 and enables the rotor 20 to rotate integrally with the drive shaft 18. A swash plate 22 is supported by the drive shaft 18. The swash plate 22 rotates integrally with the drive shaft 18 and axially inclines with respect to the drive shaft 18. A hinge mechanism 23 connects the swash plate 22 to the rotor 20. The swash plate 22 has a stopper projection 22*a*. When the stopper projection 22*a* abuts against the rotor 20, the swash plate 22 is inclined by a maximum inclination angle. Furthermore, a stopper ring 18*a* is fitted around the drive shaft 18. When the swash plate 22 abuts against the stopper ring 18*a*, the swash plate 22 is inclined by a minimum inclination angle.

A plurality of cylinder bores 24 are defined in the cylinder block 11. The cylinder bores 24 are spaced from one another by equal intervals and are arranged along a circle, the center of which coincides with the axis of the drive shaft 18. Each cylinder bore 24 accommodates a single-headed piston 25. The front end of each piston 24 is connected with the swash plate 22 through a pair of shoes 26.

As shown in FIG. 1, the valve plate assembly 13 includes a gasket 27, a first plate 28, or a suction valve plate, a main section 29, a second plate 30, or a discharge valve plate, and a third section 31, or a retainer plate.

The main plate 29 of the valve plate assembly 13 has a plurality of suction ports 29*a* and a plurality of discharge ports 29*b*, which are radially outward of the suction ports 29*a*. Each suction port 29*a* corresponds to one cylinder bore 24, and each discharge port 29*b* corresponds to one cylinder bore 24. The suction ports 29*a* and the discharge ports 29*b* are thus each located at positions corresponding to the respective cylinder bores 24. The first plate 28 has a plurality of suction valves 28*a* each corresponding to one suction port 29*a*. The second plate 30 has a plurality of discharge valves 30*a* each corresponding to one discharge port 29*b*.

Figure 2:
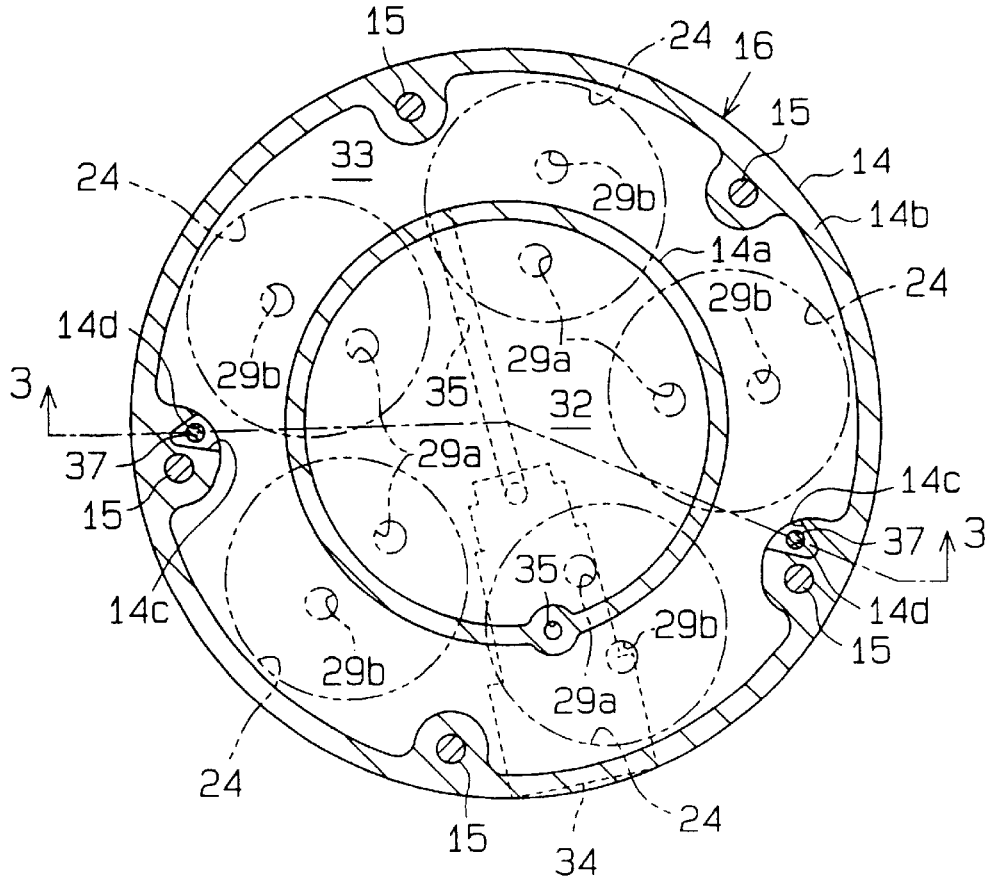
FIG. 2 is a cross-sectional view taken along line 2—2 of FIG. 1.

As shown in FIG. 2, an annular partition 14*a* extends in the interior of the rear housing section 14. The partition 14*a* separates a suction chamber 32 from a discharge chamber 33. The discharge chamber 33 surrounds the suction chamber 32. The suction chamber 32 is connected with the cylinder bores 24 through the associated suction valves 28*a* and suction ports 29*a*. The discharge chamber 33 is connected with the cylinder bores 24 through the associated discharge valves 30*a* and discharge ports 29*b*.

As shown in FIG. 1, a control valve 34 is provided in the rear housing section 14. That is, the control valve 34 is located in a supply passage 35 connecting the crank chamber 17 to the discharge chamber 33. A bleed passage 36 connects the crank chamber 17 to the suction chamber 32.

The control valve 34 controls the pressure in the crank chamber 17 (crank pressure), thus varying the compressor displacement. The crank pressure is controlled by, for example, externally adjusting the opening size of the control valve 34. Specifically, refrigerant gas flows from the discharge chamber 33 to the crank chamber 17 through the supply passage 35, while refrigerant gas flows from the crank chamber 17 to the suction chamber 32 through the bleed passage 36. The crank pressure is controlled in accordance with the difference between the flow rate gas flowing in the supply passage 35 and the flow rate of the gas flowing in the bleed passage 36. If the crank pressure increases, the inclination angle of the swash plate 22 decreases. The strokes of the pistons 25 are thus reduced such that the compressor displacement decreases. If the crank pressure decreases, the inclination angle of the swash plate 22 increases. The strokes of the pistons 25 thus increase stroke such that the compressor displacement increases.

The configuration of the valve plate assembly 13 will hereafter be described.

Figure 3:
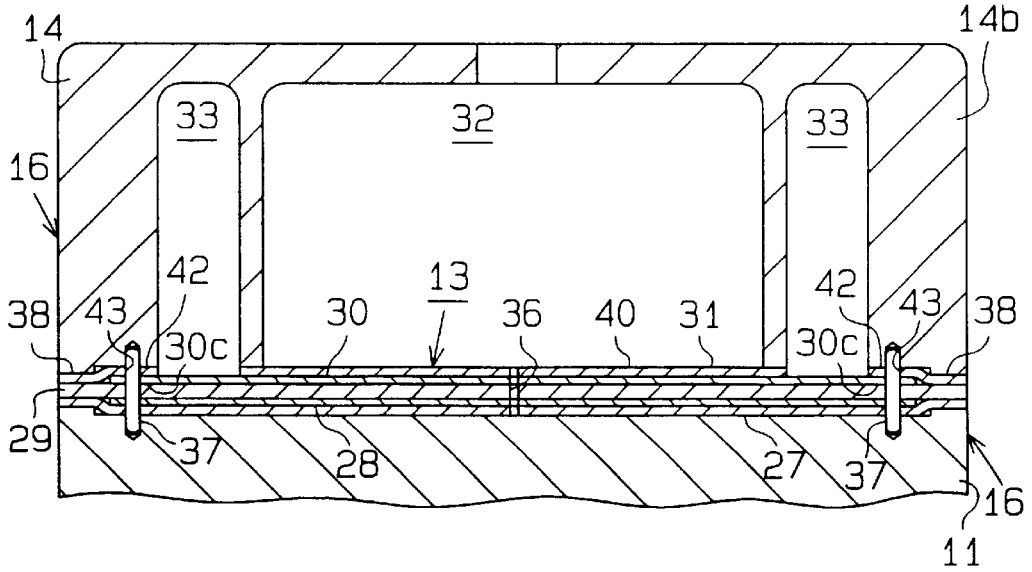
FIG. 3 is a cross-sectional view taken along line 3—3 of FIG. 2.

The first plate 28 and the second plate 30 are formed of metal. As shown in FIGS. 1 and 3, the diameter of the first plate 28 and the diameter of the second plate 30 are smaller than the outer diameter of the compressor housing 16. The main plate 29 is also formed of metal and has a diameter substantially equal to the outer diameter of the compressor housing 16. The third section 31 is formed by a metal plate, both sides of which are covered by rubber. The third section 31 thus functions as a gasket. The gasket 27 is formed by a metal plate, both sides of which are covered by rubber. The diameter of the gasket 27 is substantially equal to the outer diameter of the compressor housing 16. The rear housing section 14 includes an outer cylindrical wall 14*b*. The gasket 27, the main plate 29, and the third section 31 are clamped between the cylinder block 11 and the cylindrical wall 14*b*.

Figure 4:
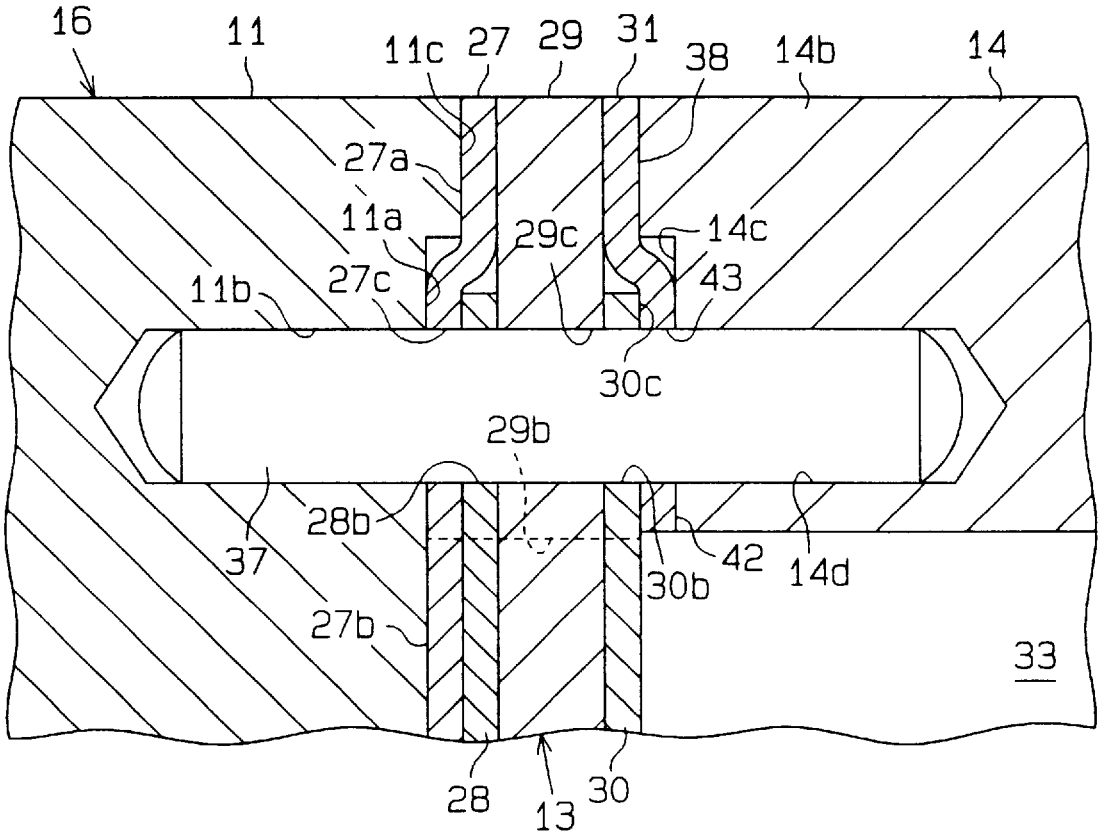
FIG. 4 is an enlarged, cross-sectional view showing a portion of a valve plate assembly positioning structure in the compressor of FIG. 1.
Figure 5:
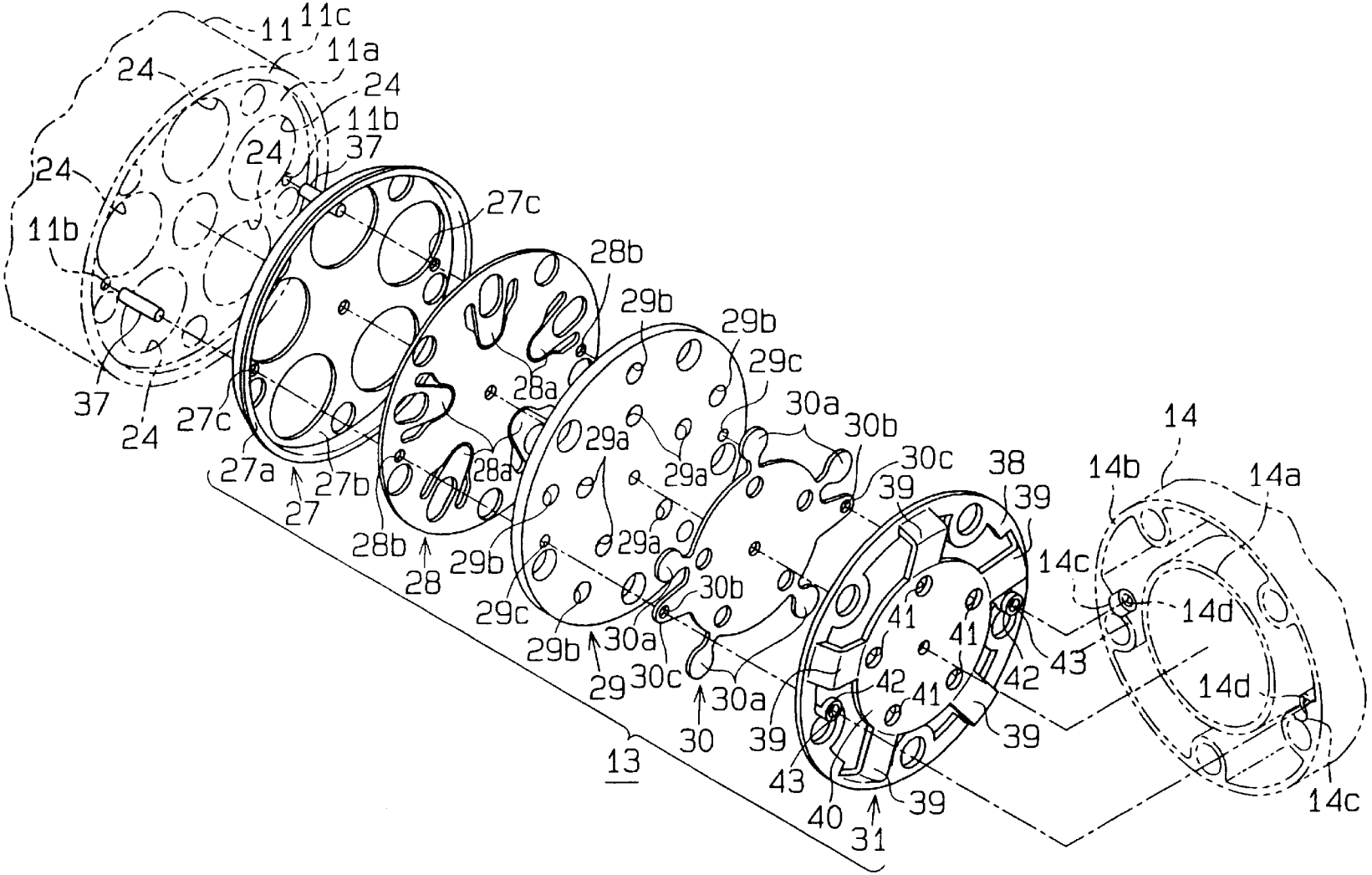
FIG. 5 is an exploded, perspective view showing a valve plate assembly provided in the compressor of FIG. 1.

As shown in FIGS. 4 and 5, a step 11*a* is formed in the end of the cylinder block 11 adjacent to the valve plate assembly 13. A pair of holes 11*b* are formed in the cylinder block 11 and are located radially outward from the axis of the cylinder block 11. A pair of pins 37, or engaging members, extend through the associated holes 11*b*. A line intersecting the center axis of one hole 11*b* and the center axis of the other hole 11*b* at right angles also intersects the axis of the cylinder block 11 at right angles. In other words, the holes 11*b* lie on a diameter of the cylinder block 11.

An annular seal 27*a* is formed along the periphery of the gasket 27. The seal 27*a* is located between the periphery, 11*c* of the cylinder block 11 and the main plate 29 of the valve plate assembly 13. The gasket 27 includes a holding member 27*b* extending toward the cylinder block 11 by a distance to the axial length of the first plate 28. The holding member 27*b* has a pair of holes 27*c* at positions corresponding to the holes 11*b* of the cylinder block 11. The pins 37 are fitted in the associated holes 27*c*. The first plate 28 is fitted in a recess defined by the holding member 27*b* and is thus located between the gasket 27 and the main plate 29.

The first plate 28 has a pair of holes 28*b* at positions corresponding to the holes 11*b* of the cylinder block 11, while the main plate 29 has a pair of holes 29*c* at positions corresponding to the holes 11*b*. In the same manner, the second plate 30 has a pair of holes 30*b* at positions corresponding to the holes 11*b*. The pins 37 are fitted in the associated holes 28*b*, 29*a*, 30*b*. As shown in FIG. 5, the second plate 30 has a pair of extensions 30*c*. The extensions 30*c* and the discharge valves 30*a* project radially outward from the center of the second plate 30. The number of the discharge valves 30*a* corresponds to the number of the cylinder bores 24 (in this embodiment, five discharge valves 39*a* are provided). The extensions 30*c* are coplanar and diametrically opposed. The extensions 30*c* are located at positions corresponding to the holes 11*b* of the cylinder block 11. Each extension 30*c* extends radially further outward relative to the associated hole 11*b* of the cylinder block 11. Furthermore, the holes 30*b*, which are located at positions corresponding to the holes 11*b* for receiving the pins 37, are each formed in the associated extensions 30*c*.

The third section 31 has a first annular portion 38 extending along the outer circumference of the third section 31. The first annular portion 38 has one side contacting the main plate 29 and the other side contacting the rear housing section 14 when the compressor is assembled. The third section 31 has a plurality of (in this embodiment, five) retainers 39 at positions corresponding to the discharge valves 30*a*. The third section 31 further has a second annular portion 40 having an outer diameter substantially equal to the outer diameter of the partition 14*a* of the rear housing section 14. The retainers 39 extend radially outward from the second annular portion 40 and are spaced from one another by equal angular intervals with respect to the axis of the third section 31. When the valve plate assembly 13 shown in FIG. 1 is installed in the compressor, each retainer 39 restricts the opening size of the associated discharge valve 30*a*. The second annular portion 40 includes a plurality of (in this embodiment, five) suction holes 41 at positions corresponding to the suction ports 29*a*.

The third section 31 includes a pair of projections 42 projecting radially inward from the first annular portion 38. The projections 42 are located at positions corresponding to the extensions 30*c* of the second plate 30. Each projection 42 has a hole 43 through which the associated pin 37 is inserted. The projections 42 and the second annular portion 40 including the retainers 39 are axially projected relative to the first annular portion 38 by an amount corresponding to the axial length of the second plate 30. In this manner, the second annular portion 40 and the projections 42 define a recess for accommodating the second plate 30. That is, as shown in FIG. 5, the second plate 30 is fitted in the recess defined by the projections 42 and the second annular portion 40 and thus located between the main plate 29 and the third section 31.

As shown in FIG. 4, the cylindrical wall 14*b* of the rear housing section 14 has a pair of accommodating recesses 14*c* at positions corresponding to the projections 42 of the third section 31. The projections 42 are thus accommodated in the associated recesses 14*c*. Each recess 14*c* has a hole 14*d* at a position corresponding to one hole 11*b* of the cylinder block 11 for receiving the associated pin 37.

As shown in FIG. 3, when assembling the valve plate assembly 13, the pins 37 inserted through the associated holes 27*c*, 28*b*, 29*c*, 30*b*, 43 positions the gasket 27, the first plate 28, the main plate 29, the second plate 30, and the third section 31 with respect to one another. Furthermore, as shown in FIGS. 3 and 4, the second plate 30 is accommodated in a recess between the main plate 29 and the projections 42 and the second annular portion 40 of the third section 31. The first annular portion 38 of the third section 31 seals a space between the main plate 29 and the cylindrical wall 14*b* of the rear housing section 14.

The first plate 28 is received in a recess between the holding member 27*b* of the gasket 27 and the main plate 29. The seal 27*a* of the gasket 27 seals a space between the main plate 29 and the periphery 11*c* of the cylinder block 11.

The above embodiment has the following advantages.

In this embodiment, the pins 37 are inserted through the associated holes 27*c*, 28*b*, 29*c*, 30*b*, 43 extending through the gasket 27, the first plate 28, the main plate 29, the second plate 30, and the third section 31, respectively. In this manner, the valve plate assembly 13 is positioned with respect to the cylinder block 11 and the rear housing section 14. This structure minimizes the number of the positions at which the valve plate assembly 13 is positioned relative to the cylinder block 11 and the rear housing section 14 (in this embodiment, two). The positioning structure for the valve plate assembly 13 is thus very simple.

Figure 6:
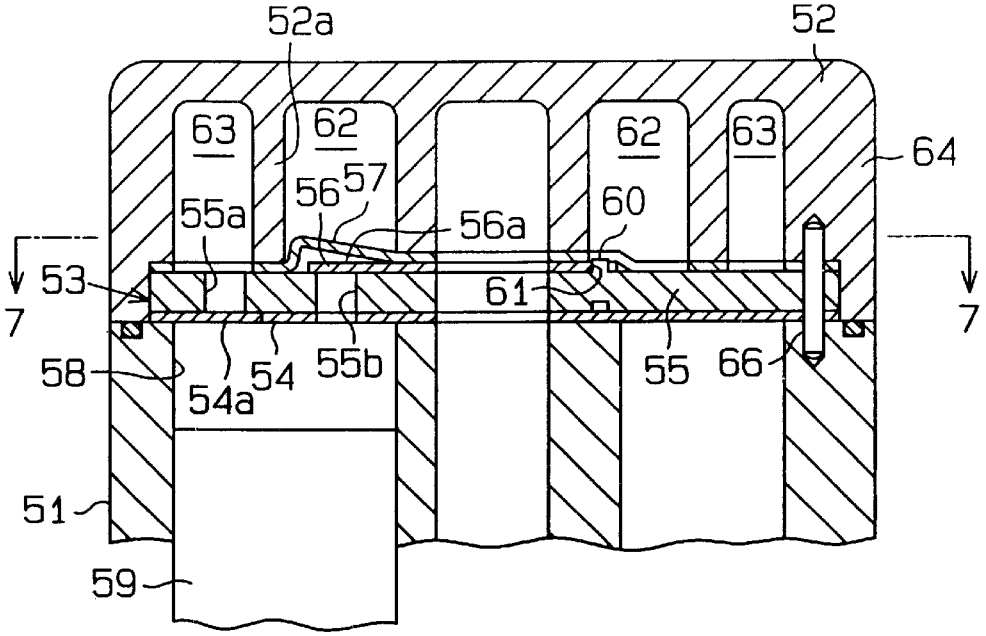
Fig.6 (Prior Art)
FIG. 6 is a cross-sectional view showing a prior-art valve plate assembly positioning structure for a compressor (a cross-sectional view taken along line 6—6 of FIG. 7)
Figure 7:
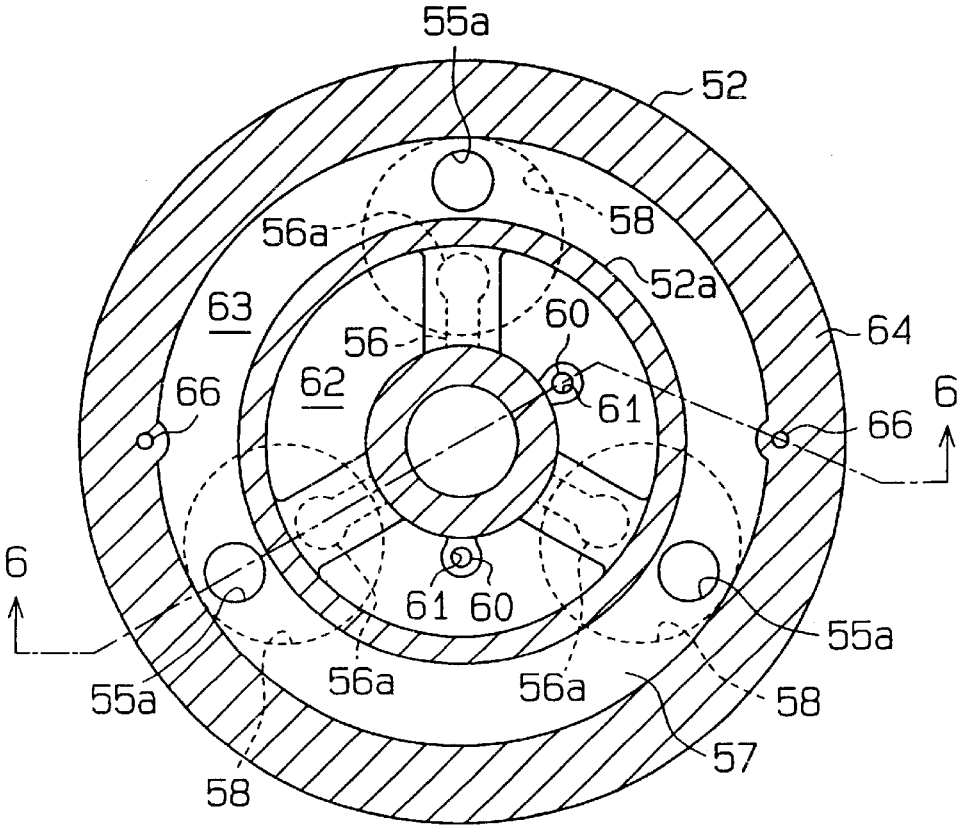
Fig.7 (Prior Art)
FIG. 7 is a cross-sectional view taken along line 7—7 of FIG. 6.

Since the pins 37 are used for positioning the valve plate assembly 13, unlike the valve plate assembly positioning structure shown in FIGS. 6 and 7, the projection 60 or pins used only for positioning the second section 56 need not be provided. That is, no press work for forming the projections 60 needs to be performed. Furthermore, the structure of the illustrated embodiment decreases the number of pins used for positioning the valve plate assembly 13. The valve plate assembly positioning structure of the present invention thus has fewer parts.

The pins 37 position all the constituents of the valve plate assembly 13 including the second plate 30 with respect to the cylinder block 11 and the rear housing section 14. In this manner, the second plate 30 is reliably assembled with the other constituents of the valve plate assembly 13, that is the gasket 27, the first plate 28, the main plate 29, and the third section 31. The second plate 30 thus does not deviate from the proper position, and is positioned accurately relative to the neighboring parts after the assembly process.

The valve plate assembly positioning structure according to the present invention is applied to a compressor having the suction chamber 32 surrounded by the discharge chamber 33. Accordingly, the diameter of the second plate 30 is larger than that of the second section 56 shown in FIGS. 6 and 7. The length of the extensions 30*c* is thus relatively small.

In the illustrated embodiment, the projections 42 are located radially inward from the first annular portion 38 of the third section 31. Thus, while functioning as a gasket sandwiched between the rear housing section 14 and the cylinder block 11, the first annular portion 38 optimally positions the second plate 30 by means of the pins 37.

The pins 37 are diametrically opposed with respect to the axis of the cylinder block 11. This enables the pins 37 to position the valve plate assembly 13 relative to the cylinder block 11 and the rear housing section 14 with high accuracy. Furthermore, the pins 37 are located at positions corresponding to the outer cylindrical wall 14*b* of the rear housing section 14. This arrangement increases the positioning accuracy of the gasket 27, the first plate 28, the main plate 29, the second plate 30, and the third section 31.

The second plate 30 is positioned at radially outer locations corresponding to the projections 42 of the third section 31. This improves the sealing characteristics of the second plate 30 with respect to the main plate 29. Thus, there is a reliable seal formed between the main plate 29 and the second plate 30.

The present invention may be modified as follows.

The third section 31 may be originally shaped flat. In this case, when assembling the valve plate assembly 13, the third section 31 is deformed to define a recess for accommodating the second plate 30. The second plate 30 is then received in the recess.

The present invention may be applied to a compressor having a discharge chamber 33 surrounded by a suction chamber 32, with an annular wall 14*a* separating the discharge chamber 33 from the suction chamber 32.

The pins 37 are not necessarily located at positions corresponding to the outer cylindrical wall 14*b* of the rear housing section 14. For example, at least one pin 37 may be located at a position corresponding to the cylindrical wall 14*b* of the rear housing section 14.

The number of the pins 37 is not restricted to two, but three or more pins 37 may be provided.

The pins 37 need not be diametrically opposed with respect to the axis of the cylinder block 11. Furthermore, the center of one of the pins 37 may be located within an angular range of twenty degrees relative to a diameter on which the other pin is located.

The axial dimension of the projection 42 of the third section 31 is not restricted to the axial dimension of the second plate 30. That is, for example, as long as a seal is formed between the main plate 29 and the third section 31, the axial dimension of the projection 42 of the third section 31 may be larger than the axial dimension of the second plate 30. Alternatively, the axial dimension of each projection 42 of the third section 31 may be less than the axial dimension of the second plate 30. In this case, when assembling the valve plate assembly 13, each projection 42 of the third section 31 is deformed to project further such that the second plate 30 is tightly in contact with the projections 42.

The pins 37 need not necessarily be inserted through both the cylinder block 11 and the rear housing section 14. Specifically, the pins 37 may be inserted through only the cylinder block 11 or the rear housing section 14.

Each pin 37 may include a threaded portion formed on one end.

The components of the valve plate assembly 13 are not restricted to combination of the gasket 27, the first plate 28, the main plate 29, the second plate 30, and the third section 31 as long as all the components (sections) of the valve plate assembly 13 are positioned by a common pin. For example, the gasket 27 need not be provided.

Instead of the third section 31 functioning as a gasket, a seal such as an O-ring may seal between the main plate 29 and the rear housing section 14.

In the illustrated embodiment, the compressor has the single-headed piston 25. However, the compressor may include double-headed pistons. Furthermore, the present invention may be applied not only to a variable displacement type compressor but also to a piston type compressor having no control valve 34.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A compressor comprising:

a cylinder block having a cylinder bore;

a housing element having a suction chamber and a discharge chamber;

a valve plate assembly including a plurality of plate elements, wherein the housing element is connected with the cylinder block through the valve plate assembly, wherein the plate elements include:

a main plate having a suction port and a discharge port;

a suction valve plate located between the main plate and the cylinder block, wherein the suction valve plate has a suction valve, which corresponds to the suction port;

a discharge valve plate located between the main plate and the housing element, wherein the discharge valve plate has a discharge valve, which corresponds to the discharge port; and a retainer plate located between the discharge valve plate and the housing element, wherein the retainer plate limits the opening amount of the discharge valve, wherein the retainer plate includes an annular portion and a projection, wherein the annular portion directly contacts and is held by the main plate and the housing element, the projection being formed by bending the retainer plate to project from the annular portion, wherein an extension of the discharge valve plate is located between the projection and the main plate; and a positioning member engaging all the plate elements to determine the position of the valve plate assembly relative to at least one of the cylinder block and the housing element, and wherein the positioning member extends through the valve plate assembly at a position corresponding to the projection.

2. The compressor according to claim 1, wherein the plate elements each have a hole, the holes being coaxial, wherein the positioning member extends through the holes, and wherein the ends of the positioning member engage the cylinder block and the housing member, respectively.

3. The compressor according to claim 1, wherein the positioning member is one of a pair of positioning pins substantially diametrically opposed with respect to the axis of the cylinder block.

4. The compressor according to claim 1, wherein the plate elements include a gasket located between the cylinder block and the suction valve plate.

5. The compressor according to claim 4, wherein the gasket includes an annular portion and a holding member, wherein the annular portion directly contacts and is held by the cylinder block and the main plate, the holding member being located radially inside the annular portion, wherein the holding member is spaced from the main plate such that the suction valve plate is located between the holding member and the main plate.

6. The compressor according to claim 1, wherein the housing element has an annular partition wall to define the suction chamber and the discharge chamber, wherein the suction chamber is located radially inside the annular partition wall and the discharge chamber is located radially outside the annular partition wall, and wherein the positioning member is located radially outside the annular partition wall.

7. A compressor comprising:

a cylinder block having a cylinder bore;

a housing element having a suction chamber and a discharge chamber;

a valve plate assembly including a plurality of plate elements, wherein the housing element is connected with the cylinder block through the valve plate assembly, wherein the plate elements each have a hole, the holes being coaxial, wherein the plate elements include:

a main plate having a suction port and a discharge port;

a suction valve plate located between the main plate and the cylinder block, wherein the suction valve plate has a suction valve, which corresponds to the suction port;

a discharge valve plate located between the main plate and the housing element, wherein the discharge valve plate has a discharge valve, which corresponds to the discharge port; and a retainer plate located between the discharge valve plate and the housing element, wherein the retainer plate limits the opening amount of the discharge valve, wherein the retainer plate includes an annular portion and a projection, wherein the annular portion directly contacts and is held by the main plate and the housing element, the projection being formed by bending the retainer plate to project from the annular portion, wherein an extension of the discharge valve plate is located between the projection and the main plate; and a pair of positioning members engaging all the plate elements to determine the position of the valve plate assembly relative to the cylinder block and the housing element, wherein the positioning members extend through the holes, the ends of the positioning member engage the cylinder block and the housing member, respectively, and the positioning members extend through the valve plate assembly at a position corresponding to the projection.

8. The compressor according to claim 7, wherein the positioning members are substantially diametrically opposed with respect to the axis of the cylinder block.

9. The compressor according to claim 7, wherein the plate members include a gasket located between the cylinder block and the suction valve plate.

10. The compressor according to claim 9, wherein the gasket includes an annular portion and a holding member, wherein the annular portion directly contacts and is held by the cylinder block and the main plate, the holding member being located radially inside the annular portion, wherein the holding member is spaced from the main plate such that the suction valve plate is located between the holding member and the main plate.

11. The compressor according to claim 7, wherein the housing element has an annular partition wall to define the suction chamber and the discharge chamber, wherein the suction chamber is located radially inside the annular partition wall and the discharge chamber is located radially outside the annular partition wall, and wherein the positioning members are located radially outside the annular partition wall.

* * * * *